United States Patent [19]

Hertenstein

[11] Patent Number: 4,973,016

[45] Date of Patent: Nov. 27, 1990

[54] DOCK FAN AND LIGHT CANTILEVER-MOUNTED ARTICULATED MULTI-ARM UTILITY SUPPORT ASSEMBLY

[75] Inventor: Harold J. Hertenstein, Fort Wayne, Ind.

[73] Assignee: Patton Electric Company, Inc., Fort Wayne, Ind.

[21] Appl. No.: 384,552

[22] Filed: Jul. 24, 1989

[51] Int. Cl.[5] ..... E04G 3/00

[52] U.S. Cl. ..... 248/282; 98/40.07; 362/432

[58] Field of Search ..... 248/278, 282, 281.1; 98/40.07, 40.08, 40.09; 362/432, 147

[56] References Cited

U.S. PATENT DOCUMENTS

| | | | |
|---|---|---|---|
| D. 116,852 | 9/1939 | Kraft | 248/282 |
| 365,859 | 7/1887 | Porter . | |
| 623,189 | 4/1899 | Smith . | |
| 941,591 | 11/1909 | Sweet . | |
| 1,002,783 | 9/1911 | Sweet . | |
| 1,796,354 | 3/1931 | Ahlberg . | |
| 1,845,931 | 2/1932 | Pace et al. | 248/278 |
| 3,193,674 | 7/1965 | Fleming | 248/278 X |
| 4,183,489 | 1/1980 | Copher et al. | 248/278 |
| 4,225,106 | 9/1980 | Eplan . | |
| 4,319,314 | 3/1982 | Morton | 248/282 X |
| 4,651,966 | 3/1987 | Suzuki . | |
| 4,696,450 | 9/1987 | Huang | 248/278 X |
| 4,726,552 | 2/1988 | Warshawsky | 248/282 X |

FOREIGN PATENT DOCUMENTS

| | | |
|---|---|---|
| 582204 | 5/1924 | France . |
| 795838 | 3/1936 | France . |

*Primary Examiner*—David L. Talbott
*Attorney, Agent, or Firm*—George Pappas

[57] ABSTRACT

A utility support assembly for mounting a dock fan and light includes an articulated multi-arm arrangement and a wall mounting bracket. The multi-arm arrangement includes a pair of inner arms and a single outer arm. The inner arms are vertically spaced apart and pivotally mounted at their inner ends to the wall mounting bracket. The outer arm at its inner end is disposed between and pivotally mounted to the outer ends of the inner arms. Also, fan and light support members are pivotally mounted at the outer end of the outer arm. The fan support member is mounted below the outer end of the outer arm, whereas the light support member is mounted above it. A fan is pivotally mounted to the fan support member and a light is pivotally mounted to the light support member. The pivotal axes of the fan and light on their respective support members are coplanar. The pivotal axes of the fan and light support members on the outer arm are coaxial to one another and parallel to the pivotal axes defined by the respective connection between outer and inner arms and between the inner arms and the mounting bracket. An electrical circuit junction box is mounted to the outer arm adjacent to its outer end.

5 Claims, 3 Drawing Sheets

DOCK FAN AND LIGHT CANTILEVER-MOUNTED ARTICULATED MULTI-ARM UTILITY SUPPORT ASSEMBLY

BACKGROUND OF THE INVENTION

The present invention generally relates to the supplying of air and light into confined work areas, such as truck trailers parked at loading docks. More particularly, the present invention relates to a cantilever-mounted, articulated, multiarm utility support assembly for a dock fan and light.

Truck trailers are typically backed up to loading docks at facilities or terminals which house cargo for loading cargo on the trailers or for receiving cargo being unloaded from the trailers. A truck trailer is normally of considerable length and holds a large amount of cargo. The cargo is ordinarily loaded and unloaded by manual labor alone, or with the assistance of a fork lift tractor. Since the trailer is usually enclosed except for its open rear end leading into the facility or terminal, air circulation and lighting in the trailer interior are generally inadequate, requiring that air and light be supplied from an external source for the comfort and safety of the dock personnel. Supplying air to the interior of the trailer is especially important in the summer months when, for example, the sunlight hitting the trailer causes the temperature within the trailer to be extremely high.

In the past, fans on various stands have been used by placing them on the facility floor and aiming the same toward the truck trailer for supplying air into its interior. However, these fans tend to get in the way of loading and unloading and, thus, making the loading and unloading procedure more difficult, time-consuming, and burdensome. Accordingly, while common fans mounted on various support stands are capable of blowing air into the trailer interior, it is difficult to situate them to effectively blow air into the interior of the trailer.

It is known to provide lights mounted on articulate arms for aiming and providing light into the trailer interior. However, a drawback with such light support articulated arm constructions is that they are not designed to facilitate immediate repair or replacement of a damaged part. For example, quite often the light is bumped or struck by the forklift tractor or by cargo being loaded and unloaded, thus, breaking the same. Replacement of the broken light, in general, requires the replacement of the entire articulated arm and/or requires wiring of the light all the way through or on the articulated arm. Thus, delays are incurred in locating or replacing the damaged light frequently necessitating stopping the loading and unloading work temporarily.

Consequently, a need exists for a means by which both air and light can be aimed toward and provided in a truck trailer backed up to a loading dock facility and which is capable of being situated in various positions so as to be out of the way while loading and unloading and yet providing the light and air as needed into the trailer, depending on how the cargo is situated therein. Further, the fan supplying the air and the light must be generally easily replaceable without the need of extensive wiring and the overall assembly must be substantially rugged to withstand general bumping and, yet, be generally inexpensive to manufacture.

SUMMARY OF THE INVENTION

The present invention provides a dock fan and light utility support assembly designed to satisfy the aforementioned needs. The support assembly of the present invention employs several features which overcome the above-described drawbacks.

One feature of the present invention relates to an articulated multi-arm arrangement of the utility support assembly which increases the maneuverability of the support assembly and the range of possible positions in which the fan and light can be placed relative to the wall from which the support assembly is mounted.

Another feature relates to the arrangement of a pair of inner arms with a single outer arm composing the multi-arms of the utility support assembly which permits the support assembly to be mounted in cantilevered fashion from the facility wall and pivotally moved relatively easily in a non-binding swinging motion in a horizontal plane through a 180 degree arc relative to the wall.

A further feature relates to the particular pivotal mounting arrangement of the fan and light on support members and the pivotal mounting arrangement of the support members on the outer end of the outer arm of the utility support assembly which provides pivoting of the fan and light about orthogonal axes thereby further increasing the maneuverability and range of possible positions in which the dock fan and light can be placed.

Still another feature relates to the mounting of an electrical junction box near the fan and light adjacent to the outer end of the outer arm of the utility support assembly for providing a termination point next to the fan and light for wiring them into the electrical circuit and also permitting their easy and quick replacement should they become damaged during use.

In one form thereof, the present invention relates to a utility support assembly for mounting a fan including a mounting member for attaching to a stationary support structure. A multi-arm arrangement is provided having inner and outer ends. The multi-arm arrangement is connected at its inner end to the mounting member for pivotal movement about a first axis and is articulated between its inner and outer ends for pivotal movement about a second axis spaced from and extending substantially parallel to the first axis. A fan support member is mounted at the outer end of the multi-arm arrangement for pivotal movement about a third axis spaced from and extending substantially parallel to the first and second axes. The fan support member has connection elements for mounting a fan thereto for pivotal movement about a fifth axis which extends in orthogonal relation to the first, second, and third axes.

In one form thereof, the present invention relates to a utility support assembly for mounting a fan and including a mounting member for attaching to a stationary support structure. An articulated multi-arm arrangement having inner and outer ends is provided. The multi-arm arrangement is pivotally connected at its inner end to the mounting member. A supporting member is mounted to the outer end of the multi-arm arrangement for supporting on or both of a fan and light. An electrical junction box is mounted adjacent to the outer end of the multi-arm arrangement adjacent to the fan support member and defining an electrical circuit termination point.

In one form thereof, the present invention relates to a utility support assembly for mounting a fan and includes a mounting member for attaching to a stationary support structure. A multi-arm arrangement is provided including a pair of inner arms and a single outer arm. All of the arms have an inner and outer end and the inner ends of the inner arms are spaced apart from one another and pivotally mounted to the mounting member. The inner end of the outer arm is disposed between and pivotally mounted to the outer ends of the inner arms. A fan support member is mounted at the outer end of the outer arm.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention in one form thereof and such exemplifications are not to be construed as limiting the scope of the disclosure or the scope of the invention in any manner.

DETAILED DESCRIPTION OF A SPECIFIC EMBODIMENT

Figure 1:
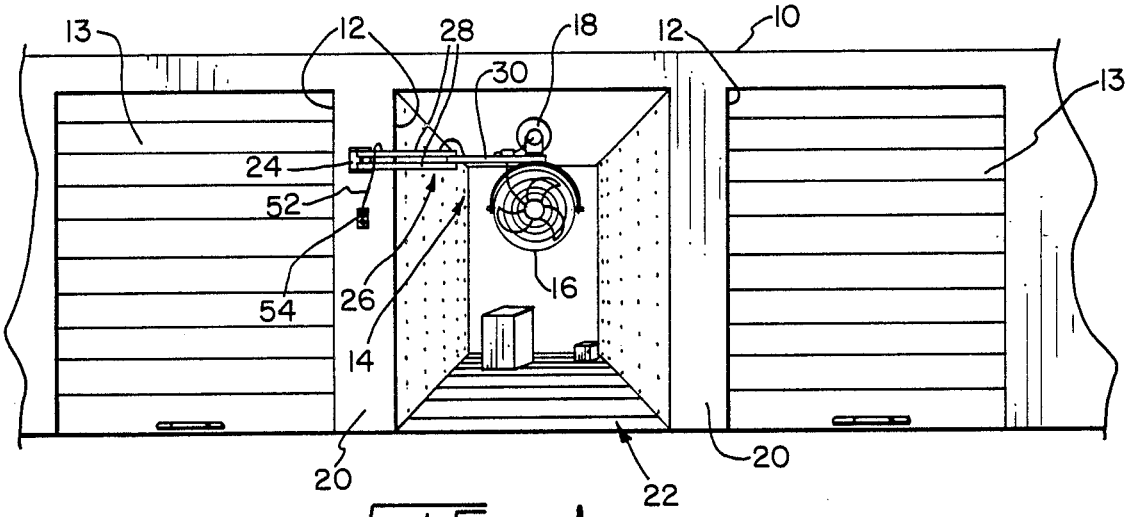
FIG. 1 is an elevational view of an articulated, multi-arm, utility support assembly for mounting a dock fan and light according to the present invention and being mounted on an interior wall of a facility having multiple loading docks.

Referring now to the drawings, and more particularly to FIG. 1, there is shown a facility 10 having multiple loading docks 12 and whereat an articulated, multi-arm utility support assembly, generally designated as 14, is shown supporting a dock fan 16 and a light 18 in accordance with the principles of the present invention. Loading docks 12 are, in general, openings whereat truck trailers 22 can be backed up against so that by opening the facility loading dock door 13 and the truck trailer door (not shown), access from the facility to the interior of the truck trailer is obtained as shown in FIG. 1. The utility support assembly 14 is swingably mounted in a cantilevered fashion on the interior wall 20 of the facility 10 between adjacent loading docks or openings 12. Thus, by selectively manipulating support assembly 14, fan 16 and light 18 supported thereon can be situated in various positions and aligned with the interior of truck trailer 22 backed up to either one of adjacent loading docks 12 on either side of wall 20.

Figure 2:
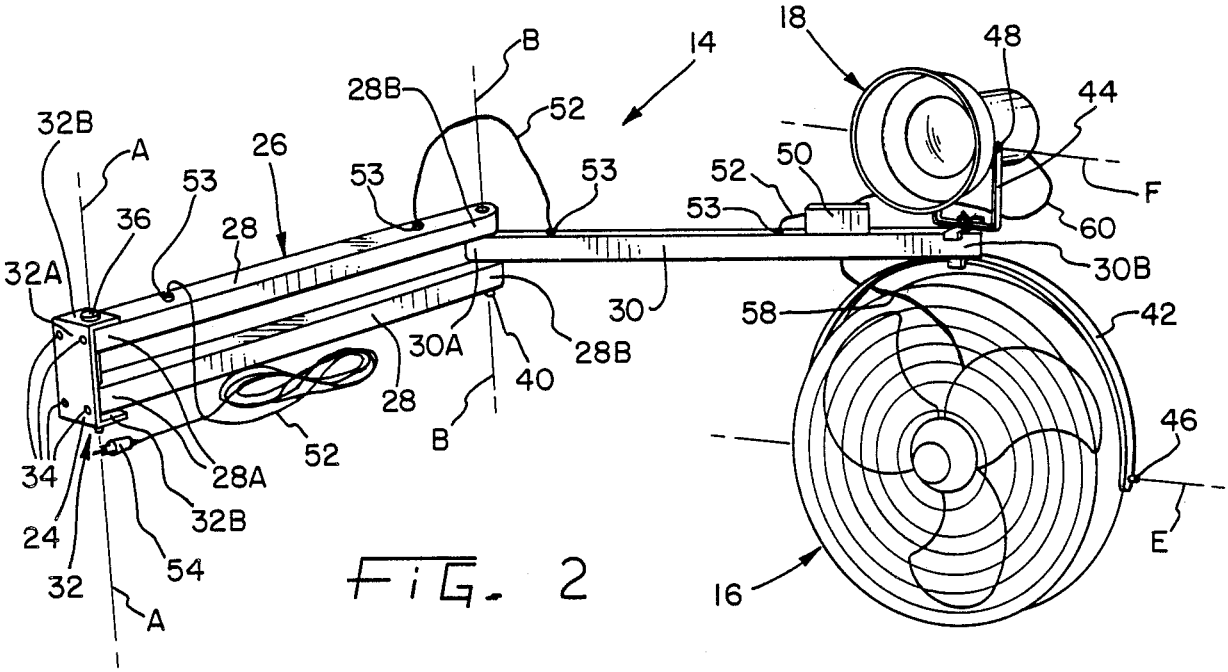
FIG. 2 is a perspective view of the utility support assembly of FIG. 1.

Referring to FIGS. 1 and 2, in its basic components, the utility support assembly 14 includes mounting member 24 adapted for attachment to the facility wall 20. An articulated multi-arm arrangement, generally indicated as 26, is pivotally mounted to mounting member 24. Multi-arm arrangement 26 is, thus, also mounted to the facility wall 20 by the mounting member 24 and extends in a cantilevered fashion from the interior wall 20. The pivotal connection between multi-arm arrangement 26 and member 24 provides for pivotal movement of the multi-arm arrangement 26 in a swinging motion through an arc of approximately 180 degrees or as may be limited by wall 20 and within a horizontal plane relative to the wall 20.

More particularly, the multi-arm arrangement 26 includes a pair of inner elongated arms 28 and a single outer elongated arm 30. Arms 28 and 30 are preferably made of hollow tubes having a square cross-sectional shape. The inner arms 28 are substantially the same in size and length. Arms 28 include inner ends 28A and also include outer ends 28B. Outer arm 30 includes an inner end 30A and an outer end 30B. Inner arms 28 are spaced apart above one another and extend substantially parallel to one another. At their inner ends 28A, inner arms 28 are pivotally mounted to the mounting member 24 about a first axis A extending vertically when the support assembly 14 is mounted to facility wall 20.

Figure 4:
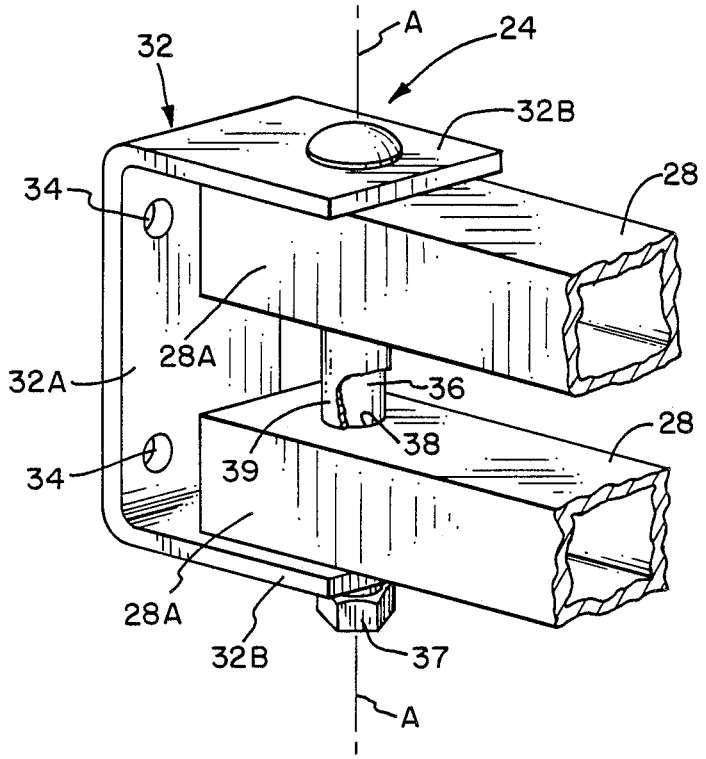
FIG. 4 is an enlarged fragmentary perspective view of the pivotal mounting connection of the inner ends of a pair of inner arms of the utility support assembly to a wall mounting member thereof according to the present invention.

Referring to FIGS. 2 and 4, the mounting member 24 of the support assembly 14 includes a bracket 32, preferably having a C-shaped configuration. Bracket 32 has a middle portion 32A with a plurality of spaced holes 34 for attaching the bracket 32 to the facility wall 20 with the use of any suitable fasteners such as screws (not shown). The bracket 32 includes a pair of end portions or extensions 32B located at the opposite ends of the middle portion 32A and preferably integrally formed therewith. Preferably, bracket 32 is made of a single metal piece wherein the end portions 32B are bent relative to the middle portion 32A so as to extend outwardly in the same direction from middle portion 32A and at right angles thereto. Mounting member 24 further includes an elongated pivot pin 36 mounted through holes (not shown) in the bracket end portions 32B. Pin 36 is also aligned and received through holes 38 in the inner ends 28A of the inner arms 28. Preferably, pin 36 is a bolt fastened and adapted to stay thereon via a lock nut 37. A sleeve member 39 is disposed between arms 28 and receives pin 36 therethrough. Sleeve 39 has a larger outside diameter than holes 38 and, thus, acts to keep arms 28 apart and generally against end portions 32B.

Figure 5:
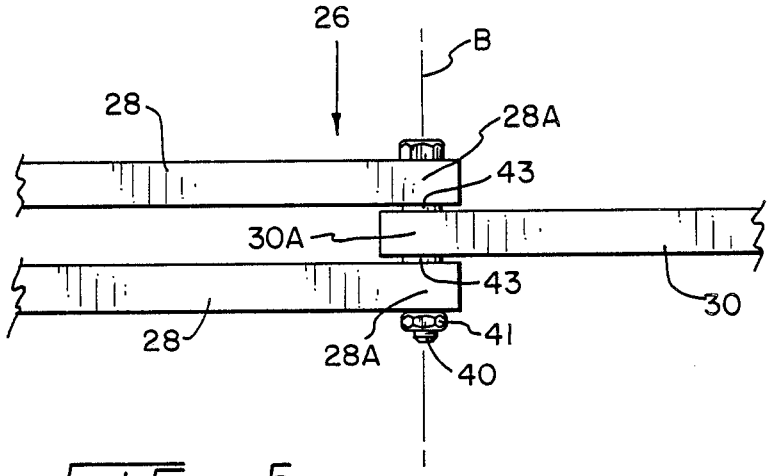
FIG. 5 is an enlarged fragmentary side elevational view of the articulated pivotal connection of the inner end of the outer arm of the utility support assembly to the outer ends of the pair of inner arms thereof according to the present invention.

Referring to FIGS. 2 and 5, the outer arm 30 of the multi-arm arrangement 26, at its inner end 30A, is disposed between and pivotally mounted to the outer ends 28B of the inner arms 28 about a second axis B. Axis B, like axis A, also extends generally vertically when the support assembly 14 is mounted to the facility wall 20. Axis B, however, is spaced from and extends substantially parallel to axis A. An elongated pin 40 extends through aligned holes (not shown) formed in the outer ends 28B of the inner arms 28 and in the inner end 30A of the outer arm 30 thereby pivotally mounting the outer arm 30 to the inner arms 28. The mounting relation of the inner end 30A of the outer arm 30 between the outer ends 28B of the inner arms 28 maintains the arms 28 vertically spaced apart from one another along their lengths and at their respective outer ends 28B. As shown in FIG. 5, elongated pin 40 is preferably a bolt received through the holes in arms 28 and 30 and fastened and retained via a lock nut 41. Washers 43 may be utilized between outer arm 30 and respective inner arms 28 for proper spacing and pivotal movement of outer arm 30 with respect to inner arms 28.

A vertically downward directed load is imposed by the weight of the fan 16 and light 18 mounted on the outer end 30B of the outer arm 30. This load is transferred to the inner arms 28 as oppositely longitudinally directed loads or forces imposed on arms 28. These longitudinally directed loads are placed on arms 28 by the outer arm 30 creating a moment on the B axis placing pin 40 in shear and whereby pin 40 acts to pull on the upper arm 28 and to push against or towards the lower arm 28. Thus, the force imposed on the lower one of the inner arms 28 places it in compression, whereas the load imposed on the upper one of the inner arms 28 places it in tension. It should be noted that these generally longitudinally directed loads on inner arms 28 are more prevalent when inner arms 28 and outer arms 30 are generally longitudinally aligned and not perpendicular with respect to one another. So as to withstand the torsional or twisting forces imposed on inner arms 28 when outer arm 30 is generally perpendicular to inner arms 28, arms 28 are sufficiently sized and rigidly connected to one another as described hereinabove with pins 36 and 40 to withstand any such torsional or twisting forces.

Utility support assembly 14 further includes a fan support member 42 and a light support member 44 mounted by a common fastener 45, such as a threaded bolt 47 and a lock nut 49. Fastener 45 is received through support members 42 and 44 and the outer end 30B of the outer arm 30 through aligned holes (not shown). Washers 43 are also mounted between support members 42 and 44 and the respective upper and lower sides of outer arm 30. Thus, the fan and light support members 42 and 44 respectively are pivotally mounted on opposite lower and upper sides of the outer end 30B of the outer arm 30.

In such an arrangement, support members 42 and 44 are pivotally mounted to the outer arm 30 about respective third and fourth axes C and D which are coaxial with one another and are spaced from, but extending parallel to, the first and second axes A and B. It should be understood that the support members 42 and 44 can be pivotally mounted to the outer arm 30 by separate fasteners and with their respective pivotal axes spaced from one another.

The fan support member 42 has a semi-circular configuration with connection elements 46 at its opposite ends, whereas the light support member 44 has a U-shaped configuration with connection elements 48 at its opposite ends. The dock fan 16 is pivotally mounted to the opposite ends of fan support member 42 by the connection elements 46 thereof about a fifth axis E. The light 18 is pivotally mounted to the opposite ends of the light support member 44 by the connection elements 48 thereof about a sixth axis F. The fifth and sixth axes E and F are spaced apart vertically from one another, and via the pivotal connections of support members 42 and 44 to outer arm 30 the fifth and sixth axes E and F can be in an infinite number of directions in horizontal planes parallel to one another. It should finally be noted that connection elements 46 and 48 are of a friction type wherethrough the fan or light may be pivoted to a given desired angle by overcoming the frictional pivotal connection of connection elements and, thereafter, retained in that position by the connection elements.

Figure 8:
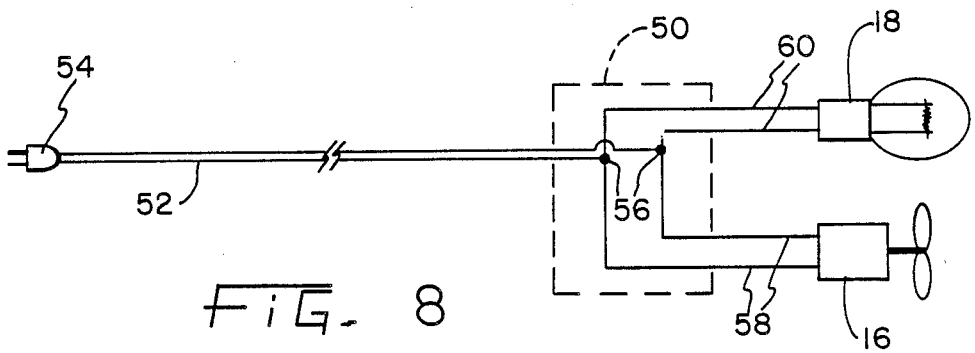

Referring now to FIGS. 2 and 8, the utility support assembly 14 includes an electrical junction box 50 mounted on outer arm 30 adjacent to the outer end 30B and also adjacent to the fan and light support members 42 and 44. An insulated electrical power cord 52 having a plug 54 at one end is routed through the upper one of the inner arms 28 and the outer arm 30 to the junction box 50. A plastic bushing 53 is used whereat cord 52 goes into or exits the square arms 28 and 30 for preventing cord 52 from being cut. The ends of power cord 52 provide a pair of electrical circuit termination points 56 located within junction box 50. Conductor wires 58, connected to and leading from fan 16, also terminate within junction box 50 and are connected to termination points 56. Conductor wires 60 leading from light 18 are also routed into junction box 50 and are electrically connected at termination points 56. Thus, as shown in FIG. 8, both fan 16 and light 18 are electrically connected to power cord 52 in parallel. This electrical connection can be by use of standard twist-on type connectors or other suitable means. By mounting the electrical junction box near fan 16 and light 18, the termination points 56 are provided substantially close to both the fan 16 and light 18. Accordingly, in the event that fan 16 or light 18 are damaged or are worn out and must be replaced, the same can be accomplished substantially easily and without having to route conductors 58 or 60 all the way back through outer arm 30 and inner arm 28.

Figure 3:
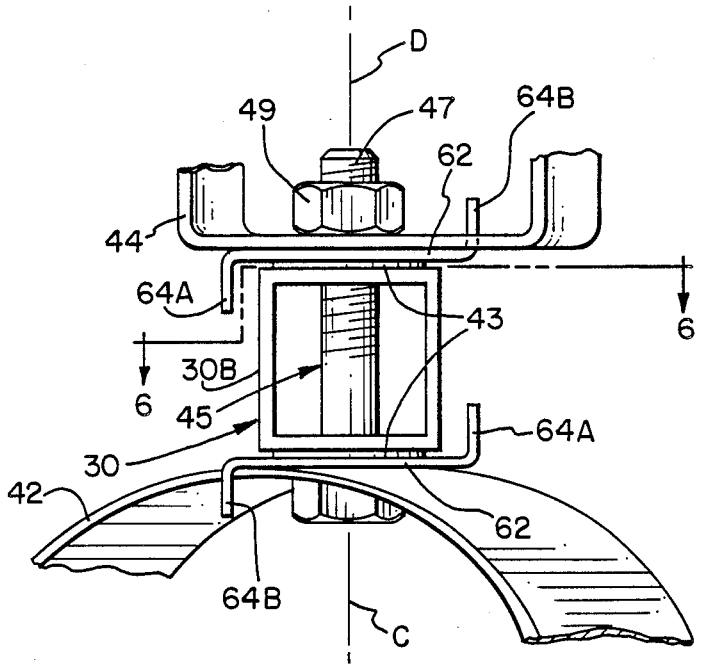
FIG. 3 is an enlarged fragmentary elevational view of swivel stops and the fan and light support members pivotally mounted on the outer end of an outer arm of the utility support assembly according to the present invention.
Figure 6:
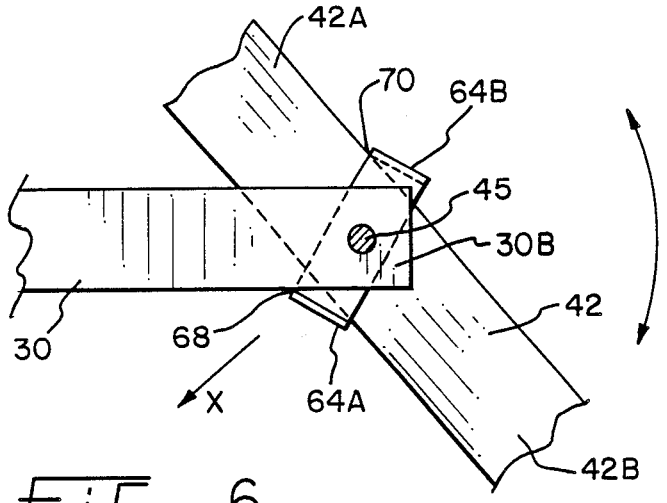
FIG. 6 is an enlarged plan view of the range of pivotal movement of the fan support member allowed by one of the swivel stops relative to the utility support assembly outer arm.
Figure 7:
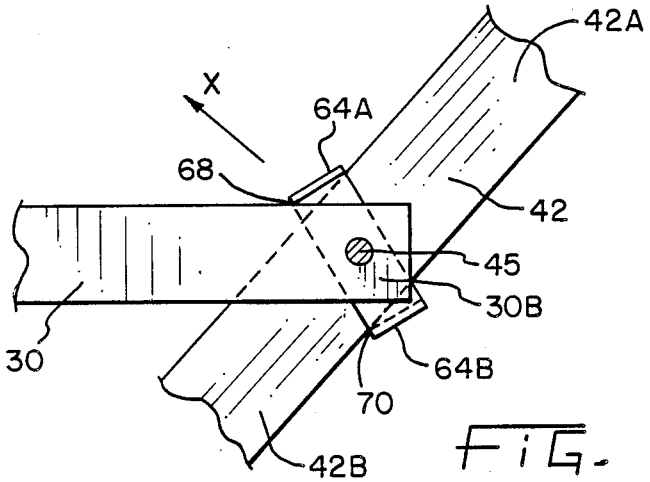
FIG. 7 is an enlarged plan view of the range of pivotal movement of the fan support member, in the other direction compared to that shown in FIG. 6, as allowed by one of the swivel stops relative to the utility support assembly outer arm; and, FIG. 8 is a schematical diagram of the electrical wiring arrangement incorporated by the utility support assembly and showing the connections to the fan and light.

As can be more clearly seen in FIGS. 2, 3, 6, and 7, swivel stops 62 are mounted between the fan support member 42 and lower side of the outer arm 30 and also between the light support member 44 and the outer arm 30. The swivel stops 62 have oppositely pointing tabs 64A and 64B integrally connected to a center portion whereat a hole is aligned with and receives therethrough pin 45. Accordingly, swivel stops 62 are adapted to pivot about either of axis C or D as are support members 42 and 44. As shown in FIG. 3, swivel stop tabs 64A point toward and are adapted to engage outer arm 30 whereas swivel stop tabs 64B point toward and are adapted to engage a respective light support member 44 or fan support member 42. Thus, swivel stops 62 limit the angle through which the fan and light support members 42 and 44 can pivot relative to the outer arm 30 thereby preventing twisting and potential breaking of their respective electrical cords 58 and 60. As shown in FIG. 6, fan support member 42 is depicted as having ends 42A and 42B. Here, tab 64A engages outer arm 30 at point 68 and fan support member 42 engages tab 64B at point 70. In this fashion, support member 42 is limited from further travel in the clockwise direction. Fan 16 can therefore direct air in the direction indicated by arrow X when fan support member 42 is pivoted in the extreme clockwise direction. The fan support member pivotal travel is also limited as shown in FIG. 7. Here, tab 64A makes contact with outer arm 30 on the other side of outer arm 30 at point 68 and fan support member makes contact with tab 64B at point 70. Here, fan 16 would be directing air as indicated by arrow X. As can be appreciated, the swivel stop associated and cooperating with light support member 44 also serves to limit that support member to an acute angle of pivotal travel in the same fashion as indicated in FIGS. 6 and 7 with respect to support member 42. It should be noted that other tabs can be utilized for limiting the travel of support members 42 and 44, such as, for example, a protrusion on either of the support members adapted to travel around outer end 30B of arm 30 and engaging arm 30 on either side thereof.

While the invention has been described as having a specific embodiment, it will be understood that it is capable of further modifications. This application is, therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A utility support assembly supporting a fan and light, comprising:

a mounting member for attaching to a stationary support structure;

a multi-arm arrangement including a pair of inner arms and a single outer arm, said arms each having inner and outer ends, said inner ends of said inner arms being spaced apart from one another and pivotally mounted to said mounting member for pivotal movement only about a first axis, said inner end of said outer arm being disposed between and pivotally mounted to said outer ends of said inner arms for pivotal movement only about a second axis spaced from and extending substantially parallel to said first axis;

a fan support member mounted at said outer end of said multi-arm arrangement for pivotal movement about a third axis spaced from and extending substantially parallel to said first and second axes, said fan support member having connection elements for mounting a fan thereto for pivotal movement about a fifth axis which extends in orthogonal relation to said first, second and third axes;

a light support member mounted at said outer end of said multi-arm arrangement for pivotal movement about a fourth axis spaced from and extending substantially parallel to said first and second axes, said light support member having connection elements for mounting a light thereto for pivotal movement about a sixth axis which extends in orthogonal relation to said first, second, and fourth axes;

said fan support member and said light support member being mounted on opposite sides of said outer end of said multi-arm arrangement, and said fourth axis extending in substantially coaxial relation with said third axes;

a fan pivotally mounted to said connection elements of said fan support member; and, a light pivotally mounted to said connection elements of said light support member.

2. The assembly as recited in claim 1, further comprising an electrical circuit junction box mounted at said outer end of said multi-arm arrangement.

3. The assembly as recited in claim 1, wherein said mounting member includes a bracket having a middle portion for attaching to the stationary support structure and a pair of end portions at opposite ends of said middle portion and extending outwardly in the same direction from said middle portion, said inner ends of said inner arms being contained between said end portions of said bracket.

4. The assembly as recited in claim 3, wherein said mounting member further includes a pivot pin mounted to and extending between said end portions of said bracket and through said inner ends of said inner arms.

5. The assembly as recited in claim 1, wherein said multi-arm arrangement further includes a pin extending through said outer ends of said inner arms and said inner end of said outer arms for pivotally mounting said outer arm to said inner arms.

* * * * *